US010235936B2

(12) United States Patent
Piper et al.

(10) Patent No.: US 10,235,936 B2
(45) Date of Patent: Mar. 19, 2019

(54) LUMINANCE UNIFORMITY CORRECTION FOR DISPLAY PANELS

(71) Applicant: Apple Inc., Cupertino, CA (US)

(72) Inventors: Johan L. Piper, Cupertino, CA (US); James C. Aamold, Campbell, CA (US)

(73) Assignee: Apple Inc., Cupertino, CA (US)

( * ) Notice: Subject to any disclaimer, the term of this patent is extended or adjusted under 35 U.S.C. 154(b) by 357 days.

(21) Appl. No.: 15/064,230

(22) Filed: Mar. 8, 2016

(65) Prior Publication Data

US 2016/0300527 A1 Oct. 13, 2016

Related U.S. Application Data

(60) Provisional application No. 62/146,185, filed on Apr. 10, 2015.

(51) Int. Cl.
*G09G 3/30* (2006.01)
*G09G 3/3233* (2016.01)

(52) U.S. Cl.
CPC ... *G09G 3/3233* (2013.01); *G09G 2300/0842* (2013.01); *G09G 2320/0223* (2013.01); *G09G 2320/0233* (2013.01); *G09G 2320/0295* (2013.01); *G09G 2360/145* (2013.01)

(58) Field of Classification Search
CPC ..... G06F 3/041; G06F 3/045; G01R 27/26; G02F 1/1343; G02F 1/13; H01L 27/32; G09G 3/30; G09G 3/36; F21V 7/04
See application file for complete search history.

(56) References Cited

U.S. PATENT DOCUMENTS

| | | | | |
|---|---|---|---|---|
| 6,414,661 | B1 | 7/2002 | Shen et al. | |
| 7,321,348 | B2 | 1/2008 | Cok et al. | |
| 7,948,392 | B2 | 5/2011 | Smith et al. | |
| 2004/0070558 | A1* | 4/2004 | Cok | G09G 3/3225 345/76 |
| 2004/0212577 | A1 | 10/2004 | Takeda et al. | |
| 2006/0077135 | A1* | 4/2006 | Cok | G09G 3/3216 345/76 |
| 2006/0170623 | A1* | 8/2006 | Naugler, Jr. | G09G 3/2011 345/76 |
| 2008/0122816 | A1 | 5/2008 | Park et al. | |

(Continued)

*Primary Examiner* — Pegeman Karimi
(74) *Attorney, Agent, or Firm* — Morgan, Lewis & Bockius LLP

(57) ABSTRACT

This application relates to systems, methods, and apparatus for reducing non-uniform luminance of an organic light emitting diode (OLED) display panel. In order to reduce non-uniform luminance, the display panel can compensate for an amount of voltage drop that is occurring across a line of the display panel. The voltage drop can be estimated based on image data provided to the display panel and one or more calibration constants stored by the display panel. The calibration constants can be generated during manufacturing of the display panel in order to equip the display panel with an accurate means for predicting voltage drop across each line of the display panel. During calibration, a predetermined display pattern is output by the display panel. Thereafter, an amount of luminance projected from the display panel is compared with an expected amount of luminance associated with the predetermined display pattern to calculate the calibration constant.

20 Claims, 7 Drawing Sheets

(56) References Cited

U.S. PATENT DOCUMENTS

| | | | | |
|---|---|---|---|---|
| 2013/0194199 | A1* | 8/2013 | Lynch | G06F 3/0412 345/173 |
| 2014/0111655 | A1* | 4/2014 | Hwang | G09G 3/3208 348/181 |
| 2015/0090988 | A1* | 4/2015 | Oooka | H01L 51/5228 257/40 |
| 2015/0187269 | A1* | 7/2015 | Hu | G09G 3/3258 345/212 |
| 2016/0086537 | A1* | 3/2016 | Shin | G09G 3/3225 345/207 |
| 2016/0189620 | A1* | 6/2016 | Park | G09G 3/3258 345/690 |

* cited by examiner

LUMINANCE UNIFORMITY CORRECTION FOR DISPLAY PANELS

CROSS-REFERENCE TO RELATED APPLICATIONS

The present application claims the benefit of U.S. Provisional Application No. 62/146,185, entitled "LUMINANCE UNIFORMITY CORRECTION FOR DISPLAY PANELS" filed Apr. 10, 2015, the content of which is incorporated herein by reference in its entirety for all purposes.

FIELD

The described embodiments relate generally to display panels. More particularly, the present embodiments relate to systems, methods, and apparatus for reducing non-uniform luminance occurring at an organic light emitting diode (OLED) display panel.

BACKGROUND

The resolution of many display panels has rapidly increased in recent times due to advances in fabrication and light emitting diode (LED) technology. These advances have led to the introduction of thin form factor displays that cover large surface areas. However, because pixel density in many of larger displays has also increased, readily charging each pixel to accurately display image data has become an increasing issue. For example, in larger displays where currents must be transmitted rapidly over supply lines, many pixels are inadequately charged due to the voltage depletion that can occur across the supply lines. As a result, the luminance across the display panel can appear less uniform thereby degrading the user experience.

SUMMARY

This paper describes various embodiments that relate to compensating drive signals for a display panel in order to correct non-uniform luminance caused by voltage drops across lines of the display panel. In some embodiments a display panel is set forth. The display panel can include a pixel array comprising a plurality of supply lines and a plurality of pixels connected to the plurality of supply lines. The display panel can further include a display driver configured to provide a signal to at least one supply line of the plurality of supply lines. Additionally, the display panel can include a processor configured to compensate the signal based on a luminance correction factor that is calculated by the processor using at least serial image data that is configured to be output by the plurality of pixels of the pixel array. The display panel can also include a memory configured to store a predetermined calibration constant associated with a supply lines, pixel, or sub-pixel of the display panel, wherein the luminance correction factor is further calculated by the processor using at least the predetermined calibration constant.

In other embodiments, a method for reducing non-uniform luminance exhibited by a display panel is set forth. The method can be performed by any suitable display device such as a processor of the display panel. The method can include steps of calculating a luminance correction factor based on (i) a portion of image data to be output by one or more pixels of the display panel, and (ii) at least one predetermined calibration constant. The method can further include a step of generating a compensated signal for the one or more pixels of the display panel based on the luminance correction factor. Additionally, the method can include a step of causing the one or more pixels of the display panel to illuminate according to the compensated signal.

In yet other embodiments, a display driver is set forth. The display driver can include a plurality of supply line outputs configured to provide a signal to a plurality of pixels of a display panel. The signal can be compensated by the display driver based on image data received by the display driver. The image data can correspond to one or more previously displayed images, a current image being displayed or scanned, an image to be displayed in the future, and/or any combination thereof. For example, in some embodiments, the signal can be compensated based on image data related to a succession of images previously displayed. The display driver can further include a memory configured to store one or more calibration constants corresponding to one or more supply lines, columns, rows, pixels, and/or sub-pixels to be charged by the display driver. Additionally, the display driver can include a logic unit configured to calculate an amount of compensation to apply to the signal to reduce non-uniform luminance at the display panel. The amount of compensation can be based on (i) the at least one calibration constant and (ii) a sum of an expected amount of current to be used to charge different pixels of the display panel according to the image data.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
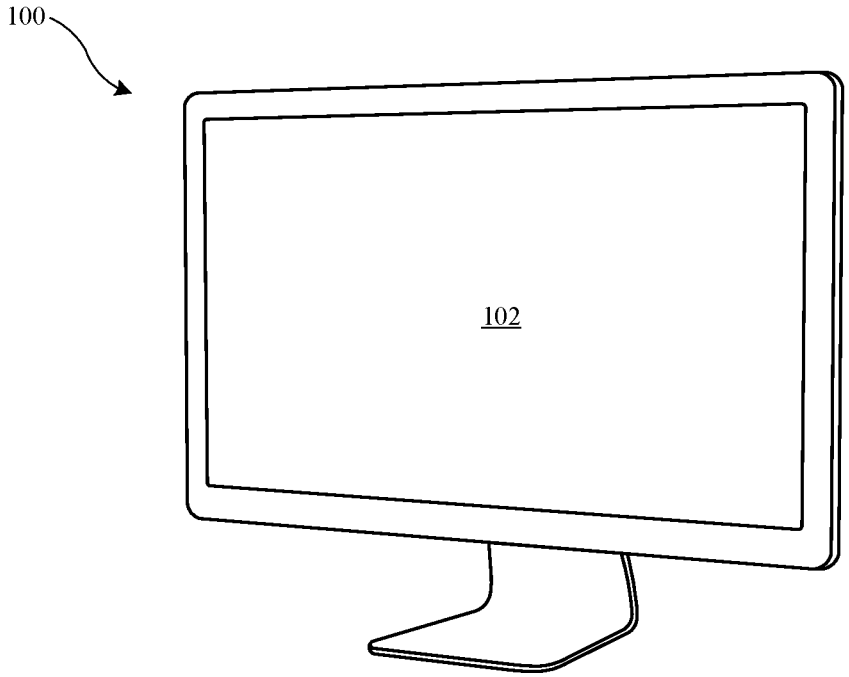
FIGS. 1A and 1B illustrate perspective views of an organic light emitting diode (OLED) display panel and a portion of an OLED matrix for the OLED display panel.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Display panels have become more advanced since the inception of light emitting diodes (LEDs), which have allowed for the design of very thin and vibrant display panels. Certain display panels have incorporated organic LEDs (OLEDs), which have allowed for the design of larger and more energy efficient display panels. Although OLED display panels provide many benefits over previous LED display panels, the circuitry inherently required to distribute current within a high resolution OLED display can prove inadequate in some designs where current is limited. For example, in high-resolution OLED displays where there are a large number of supply lines and pixels supply lines, non-uniformities in luminance of the OLED display can occur due to voltage drops across the supply lines. As a result, pixels that are further from a display driver than other pixels in a given supply line may not receive adequate charge when illuminating. As a result, luminance in certain portions of the OLED display panel can appear non-uniform compared to other portions of the OLED display panel. In order to resolve the issue of non-uniformity, a current or voltage provided to each supply line or pixel can be compensated using a luminance correction factor. The luminance correction factor can be based at least in part on the expected amount of current consumed by other supply lines and/or pixels, and one or more calibration constants, as further discussed herein.

The calibration constants used to calculate an amount of current or voltage compensation for each supply line and/or pixel can be determined during an initial calibration of an OLED display. During the initial calibration, the OLED display panel can output one or more predetermined display patterns. Thereafter, the luminance of the OLED display at one or more measurement points can be measured and used to calculate a luminance error. The luminance error is a value corresponding to a difference in the measured luminance and an expected luminance for a measurement point. For example, when the OLED display is outputting an all-white pattern, each pixel in the OLED display should ideally receive an equal amount of voltage or current corresponding to the expected luminance. However, because of the depletion of charge or voltage that occurs at the capacitors of each supply line and the number of pixels in each supply line, current will vary linearly across a supply line and the voltage will vary non-linearly across the supply line, leading to an inadequate charging of pixels. Additionally, the current consumption of other supply lines can affect the voltage drop of a supply line because on the interconnectivity of each supply line in the OLED display, further exacerbating the issue of non-uniformity.

During calibration, once the measured luminance at the measurement point is found, the luminance error can be calculated in order to derive a calibration constant for one or more supply lines or pixels corresponding to the one or more measurement points. For example, the measured luminance at the measurement point can be compared to the expected luminance at the measurement point in order to derive the luminance error. The expected luminance can be determined from an amount of current that is designated for a pixel when displaying a predetermined display pattern during the calibration. Therefore, a pixel at the end of a first supply line can be designated to receive a current $i_D$, which is approximately proportional to the expected luminance of the pixel when the pixel is receiving the current $i_D$. If the expected luminance does not correspond to or substantially equal the measured luminance, the calibration constant can be calculated to account for the disparity between the expected luminance and the measured luminance. The amount of compensation created by the calibration constant can depend on a supply line (i.e., a row line or a column line) number corresponding to a location of a supply line within a sequence of supply lines, and/or the location of a pixel to be compensated within a supply line. Therefore, a unique calibration constant can be calculated for each sub-pixel, pixel, pixel color, group of pixels, and/or supply line in order to improve the uniformity of luminance for the entire OLED display panel. Additionally, a single calibration constant can be derived for the entire OLED display panel in order to improve the uniformity of luminance for the entire OLED display.

During operation of the display panel, a luminance correction factor can be calculated based on image data and one or more calibration constants. The luminance correction factor can be a product of the calibration constant, an expected pixel luminance, and an expected voltage drop of one or more supply lines or pixels. The expected voltage drop of the one or more supply lines or pixels can be calculated based on the image data. Therefore, because luminance is approximately proportional to the current provided to a pixel, the image data can be converted into current values for calculating the luminance correction factor in real time during operation of the OLED display. For example, when image or frame data is provided to a graphics memory connected to the OLED display, preprocessing of the image data can be performed. Thereafter, the image data can be converted into serial data that is scanned out on a per pixel basis and used to calculate the luminance correction factor. The luminance correction factor can be calculated on a per pixel or supply line basis using the calibration constant for each pixel or supply line and the expected voltage drop for a pixel or supply line, and optionally a total current for all pixels. The luminance correction factor can thereafter be converted to a current, voltage, or other signal that is used to modify the current or voltage provided to one or more pixels or supply lines of a display panel. In this way, luminance uniformity can be substantially improved using one or more calibration constants previously calculated for use by an OLED display. In some embodiments, a second order correction process is used to further improve luminance uniformity. The second order correction process uses the calculation of the luminance error previously discussed and adds, to the luminance error, a second order correction factor. The second order correction uses the square of a voltage drop for one or more rows or pixels. In this way, any growth in luminance error can be curbed by the second order correction factor in order to further promote uniform luminance across the display panel.

These and other embodiments are discussed below with reference to FIGS. 1-7; however, those skilled in the art will readily appreciate that the detailed description given herein with respect to these Figures is for explanatory purposes only and should not be construed as limiting.

Figure 1B:
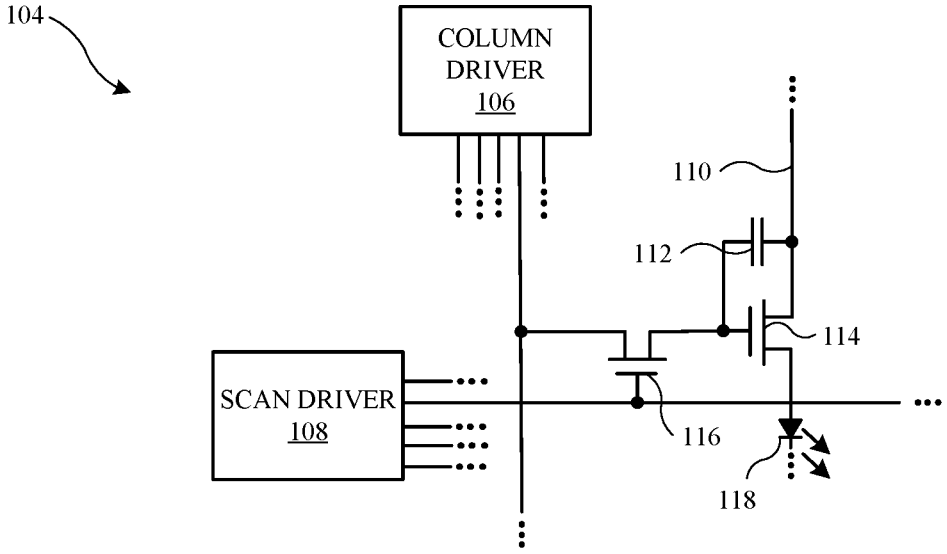

FIGS. 1A and 1B illustrate perspective views 100 of a simplified circuit of an organic light emitting diode (OLED) display panel 102 and an OLED array 104. The OLED display panel 102 can be a display panel using an OLED array 104 to output light at the OLED display panel 102. It should be noted that the term display panel as used herein can refer to the display of a laptop computing device, desktop computing device, media player, cellular phone, television, or any other electronic device incorporating a display having LEDs and/or OLEDs. FIG. 1B illustrates an OLED array 104 for use in the OLED display panel 102, or any other suitable display device. However, it should be noted that FIG. 1B is merely provided as an example of an LED circuit for a display panel and should not be viewed a limiting the scope of the disclosure. Therefore, any of the embodiments discussed herein can be applied to any suitable LED circuit arrangement in order to improve luminance uniformity at a display panel.

The OLED array 104 of FIG. 1B can include any suitable number of OLEDs 118, but for simplicity, a single OLED 118 is illustrated. Each OLED 118 can receive a supply signal from a column driver 106 and a supply line 110. During operation of the OLED array 104, a scan driver 108 can provide a signal to a gate of a first transistor 116, which allows for a signal to be provided from the column driver 106 to a gate of a second transistor 114. The second transistor 114 can be coupled to a capacitor 112 that is charged by the supply line 110 and provides a charge for the OLED 118. The OLED 118 will receive the charge from the capacitor 112 when the first transistor 116 closes as a result of receiving signals from the scan driver 108 and the column driver 106. Thereafter, the second transistor 114 will close as a result of the column driver 106 and the scan driver 108 providing signals to the first transistor 116, and the supply line 110 providing a signal to the second transistor 114. The signal from the column driver 106 and the charge from the capacitor 112 will pass through the closed second transistor 114 thereby causing the OLED 118 to illuminate. The OLED 118 can illuminate even after the signal from the scan driver 108 and/or the column driver 106 have terminated their respective signal because of the charge stored by the capacitor 112. Unfortunately, in OLED display panels having numerous OLEDs 118, the amount of charge available to each OLED 118 can be depleted more quickly based on a distance the OLED 118 is from the column driver 106 and/or the scan driver 108. In order to compensate for the charge or voltage depletion of the capacitors 112, the column driver 106 can be programmed to compensate the signal provided to the OLED 118 based on image data received by the OLED display panel 102. The compensation can further be based on a calibration constant that is based on a calibration of the display panel 102. In some embodiments, the charge depletion can be mitigated in by reprocessing the image data to compensate for an expected amount of voltage drop that will occur at the OLED display panel 102, at one or more supply lines of the OLED display panel 102, and/or at one or more OLEDs or pixels of the OLED display panel 102.

Figure 2:
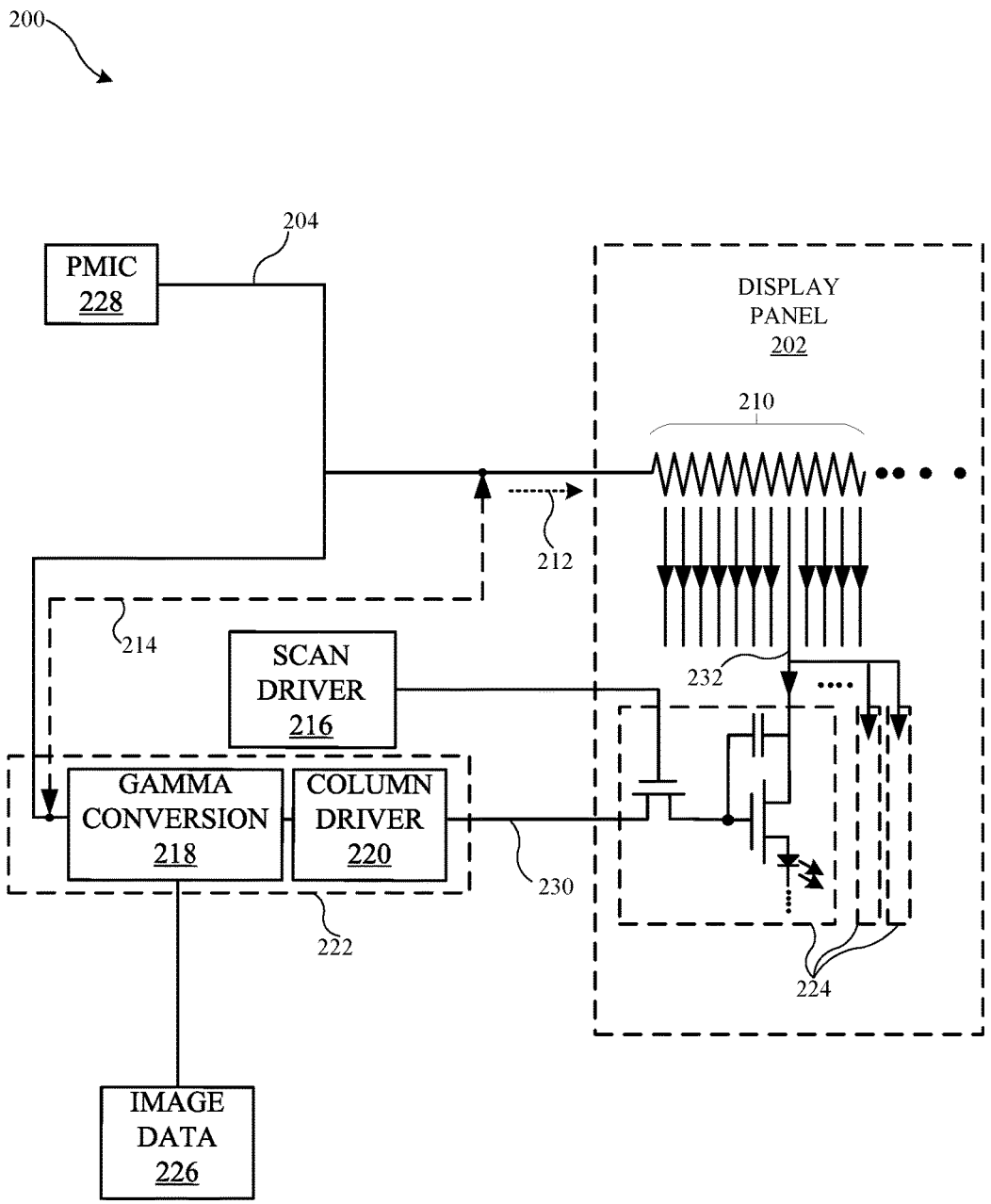
FIG. 2 illustrates a system diagram of a display panel that is configured to compensate for voltage drops across one or more supply lines of the display panel.

FIG. 2 illustrates a system diagram 200 of a display panel 202 that is configured to compensate for voltage drops across a column line 230 and/or a row line 232. The display panel 202 can be connected to a power management integrated circuit (PMIC) 228, which provides a supply voltage 204 for the display panel 202. A scan driver 216 and a column driver 220 are provided to supply a charge for each pixel circuit 224 in order to effectively illuminate each pixel of the display panel 202. The column driver 220 is part of an organic light emitting diode (OLED) driver 222, which can include a gamma conversion module 218. The gamma conversion module 218 can receive image data (e.g., compressed RGB (red, green, blue) domain data) from an image data module 226 and convert the image data into linear luminance domain data. The OLED driver 222 can be programmed to compensate for a voltage drop in the reference voltage 214 caused by a line resistance 210 in the display panel 202. Compensating for the voltage drop ensures that an adequate source current 212 is provided to each row line 232 and/or column line 230 and that uniform luminance is projected across the display panel 202. Programming the OLED driver 222 to compensate for the voltage drop can be initiated during manufacturing when a calibration constant is generated for the display panel 202, as further discussed herein.

Figure 3A:
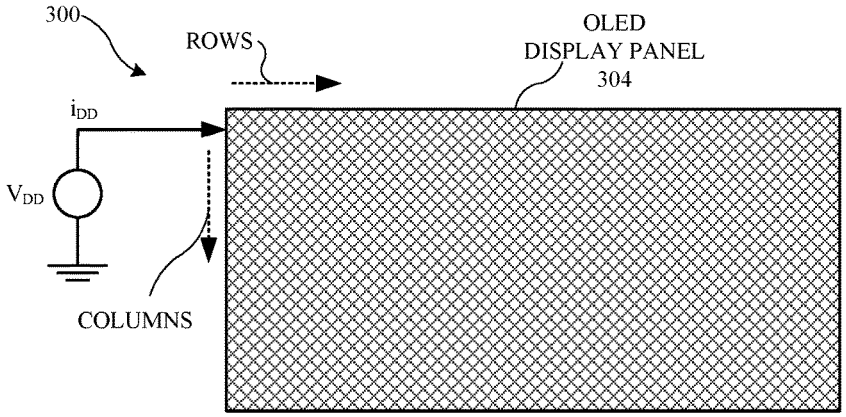
FIG. 3A illustrates techniques for calibrating an organic light emitting diode (OLED) display panel.

FIG. 3A illustrates a technique for calibrating an OLED display panel 308. Specifically, FIG. 3A illustrates a system diagram 300 of a display panel section 306 that is receiving a source current, $i_{DD}$, from a voltage source $v_{DD}$. The source current is applied across one or more supply lines of the display panel section 306 in order to cause the display panel section 306 to illuminate according to a predetermined display pattern. During calibration, a luminance measurement is taken at one or more different measurement points simultaneous to the predetermined display pattern being displayed at the OLED display panel 308. A measurement of luminance can thereafter be used to determine a calibration constant. For example, the measurement of luminance can be compared to an expected amount of luminance in order to estimate the amount of voltage drop occurring across the OLED display panel 308. The voltage drop can thereafter be used to derive a suitable calibration constant that can be stored by the OLED display panel 308 and used to improve luminance uniformity during later operations of the OLED display panel 308. The OLED display panel 308 can store one or more calibration constants that each correspond to a portion of the OLED display panel 308, one or more supply lines of the OLED display panel 308, and/or one or more pixels of the OLED display panel 308.

In some embodiments, the calibration of the OLED display panel 308 is performed by using a predetermined display pattern that is configured to cause the first and last row of the OLED display panel 308 to illuminate. In other embodiments, the calibration of the OLED display panel 308 is performed by taking multiple measurements of luminance across the OLED display panel 308 when the OLED display panel 308 is display one or more predetermined display patterns. In yet other embodiments, calibration of the OLED display panel 308 is performed by taking one or more measurements of luminance of the OLED display panel 308 when the OLED display panel 308 is a solid white display pattern. Furthermore, calibration of the OLED display panel 308 can be performed by measuring luminance of the OLED display panel 308 when the OLED display panel 308 is outputting one or more solid white image, solid red images, solid green images, and/or solid blue images, and/or any combination thereof. In this way, a calibration constant can be calculated for each of the one or more solid white images, the solid red images, the solid green images, and/or the solid blue images. Thereafter, one or more of the calibration constants can be used to compensate a signal for charging one or more red pixels, green pixels, and/or blue pixels. Furthermore, one or more weighting factors can be stored and used to further compensate signals provided to different colored pixels based on how each of the different colored pixels affect each other during operations. These weighting factors can be derived during any of the calibration methods discussed herein. Additionally, the weighting factors, as well as the calibration constants, can be based upon the material makeup of each of the red pixel, green pixel, and blue pixel.

Figure 3B:
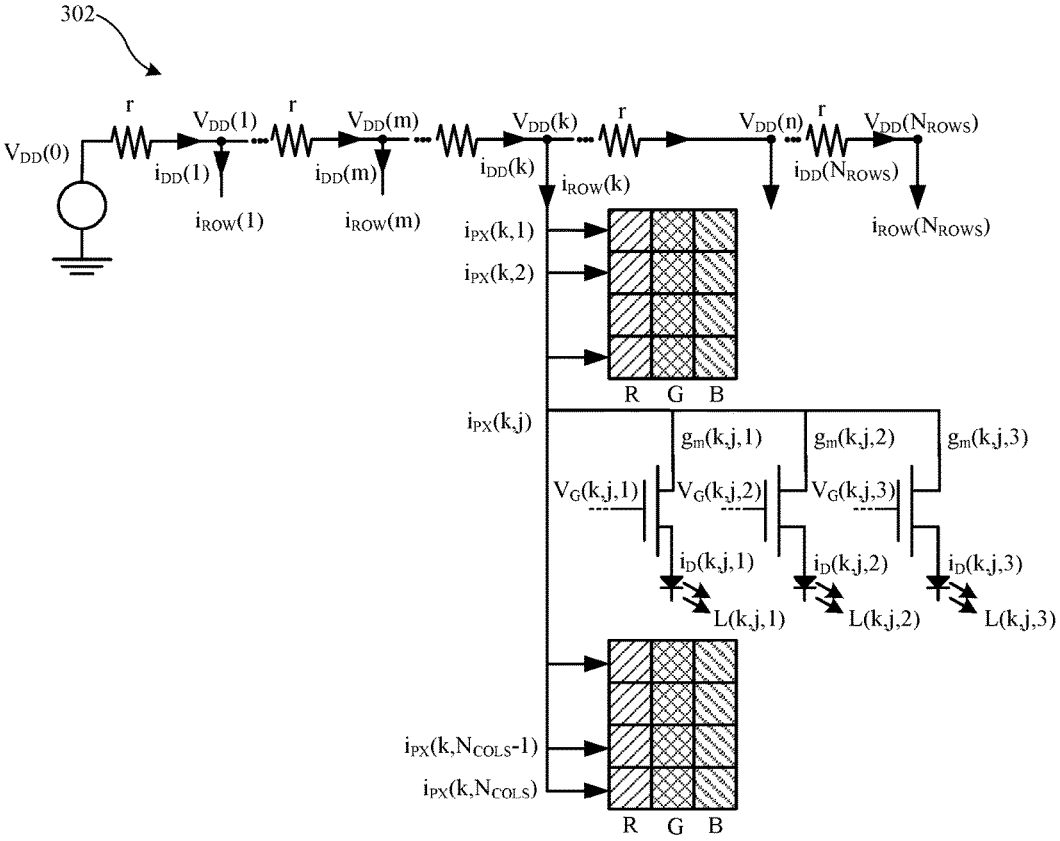
FIG. 3B illustrates a circuit diagram of a portion of an OLED display circuit.

FIG. 3B illustrates a simplified diagram 302 of the connectivity of pixels to a supply line of the OLED display panel 308. The simplified diagram 302 can be used to understand how current and voltage is distributed through the OLED display panel 308, as well as how expected luminance and measured luminance can be compared to determine voltage drop for a given supply line or pixel. Expected luminance can be calculated from a pixel current according to Equation (1) below, where $\eta_C$ is a diode efficiency constant that is constant for a particular diode and/or panel technology.

$$i_D(k, j, h) = \frac{L(k, j, h)}{\eta_c} \tag{1}$$

Equation (1) can be used to determine an expected luminance for a predetermined display pattern. For example, a predetermined pixel current will be provided to a pixel in the display panel section 306 for any given predetermined display pattern. The pixel can be any one of the sub-pixels corresponding to $i_D(k, j, 1)$, $i_D(k, j, 2)$ and/or $i_D(k, j, 3)$ of FIG. 3B. In order to determine the voltage drop during calibration, a sum of currents used to illuminate a portion of the display, such as display panel section 306, is calculated. For example, a sum of individual pixel currents corresponding to a group of pixels (i.e., red (R), green (G), and blue (B)) is calculated according to Equation (2) below, which references the pixels currents of FIG. 3B.

$$i_{PX}(k, j) = \sum_{h=1}^{3} i_D(k, j, h) \tag{2}$$

Next, a sum of the pixel currents for a single supply line is calculated by summing all of the pixel currents corresponding to each group of pixels in a supply line. The sum of pixel currents for a single supply line (i.e., a row line or a column line) can be calculated according to Equation (3) below.

$$i_{ROW}(k) = \sum_{j=1}^{N_{COLS}} i_{PX}(k, j) \tag{3}$$

Next, supply line currents corresponding to the voltage drop summed according to Equation (4) below. The summation of these supply line currents represents the total amount of current used to illuminate the OLED display panel 308 and can be used to calculate an expected voltage drop.

$$i_{DD}(m) = \sum_{k=m}^{N_{ROWS}} i_{ROW}(k) \tag{4}$$

In order to calculate the expected voltage drop, a resistance r corresponding to the resistance between each supply line, as illustrated in FIG. 3B, is multiplied by the sum of the supply line currents calculated in Equation (4). The resulting product is thereafter subtracted from the initial voltage $V_{DD}(0)$ illustrated in FIG. 3B and as provided in Equation (5) below, where m is a supply line number and n is a supply line number corresponding to the supply line for which a voltage drop is being calculated.

$$v_{DD}(n) = v_{DD}(0) - r\sum_{m=1}^{n} i_{DD}(m) \tag{5}$$

In order to determine a calibration constant for each supply line, group of pixels, and/or individual pixels, a change in expected voltage drop $v_{DD}(n)$ can be converted to an expected change in luminance according to Equation (6). In Equation (6), $\eta_C$ is a diode efficiency constant and $g_m$ is defined by Equation (7), where $K_P$ is a transconductance parameter of a transistor in the display panel section 306 and $i_D$ is the pixel current.

$$\Delta L(n,j,h) = \eta_C g_m \Delta v_{DD} \tag{6}$$

$$g_m = \sqrt{2K_P i_D} \tag{7}$$

Once an expected change in luminance for a supply line, group of pixels, and/or individual pixel is calculated, the expected change in luminance can be compared to the measured luminance that is taken during the calibration. Because the expected change in luminance is based on essentially pixel data that is converted into pixel currents that are summed for a given display panel section 306, the expected change in luminance is an estimated or ideal change in luminance. This expected change in luminance can be compared to the measured luminance of one or more portions of the display panel section 306. In some embodiments, during calibration, portions of a display panel can be sequentially illuminated and measured according to a predetermined display pattern. For one or more sequences or iterations, a luminance value is measured and summed with any previously measured luminance values.

A measured voltage drop can be calculated according to Equation (8) set forth below, where n is a row number associated with the expected voltage drop and m is a starting row number (e.g., 1) for deriving $f_{SUM}(n)$. Because of the relationship between luminance and pixel current, the measured luminance can be converted into the measured voltage drop for purposes of determining one or more calibration constants.

$$f_{SUM}(n) = \sum_{m=1}^{n}\sum_{k=m+1}^{N_{ROWS}}\sum_{j=1}^{N_{COLS}}\sum_{h=1}^{3} L(k, j, h) \cong 3N_{COLS}\sum_{m}^{n}\sum_{k=m+1}^{N_{ROWS}} L_{ROW}(k) \tag{8}$$

During calibration, the measured voltage drop $f_{SUM}(n)$ for a row n, can be multiplied by a square root of a diode luminance and the resulting product can be used to calculate the calibration constant $C_{LUM}$ according to Equation (9) set forth below.

$$\Delta L(n,j,h)=C_{LUM}\sqrt{L(n,j,h)}f_{SUM}(n) \quad (9)$$

The resulting value for $C_{LUM}$ for one or more rows and/or pixels can thereafter be stored by a computer performing the calibration or by the display panel that is being calibrated. The display panel can store one or more calibration constants $C_{LUM}$ and associate each calibration constant with a row, a group of pixels, an individual pixel, and/or an entire display panel. In this way, the calibration constant $C_{LUM}$ can be used by the display panel to perform real time adjustments to a signal provided to one or more rows, columns, and/or supply lines of the display panel to improve luminance uniformity, as discussed herein.

Figure 4:
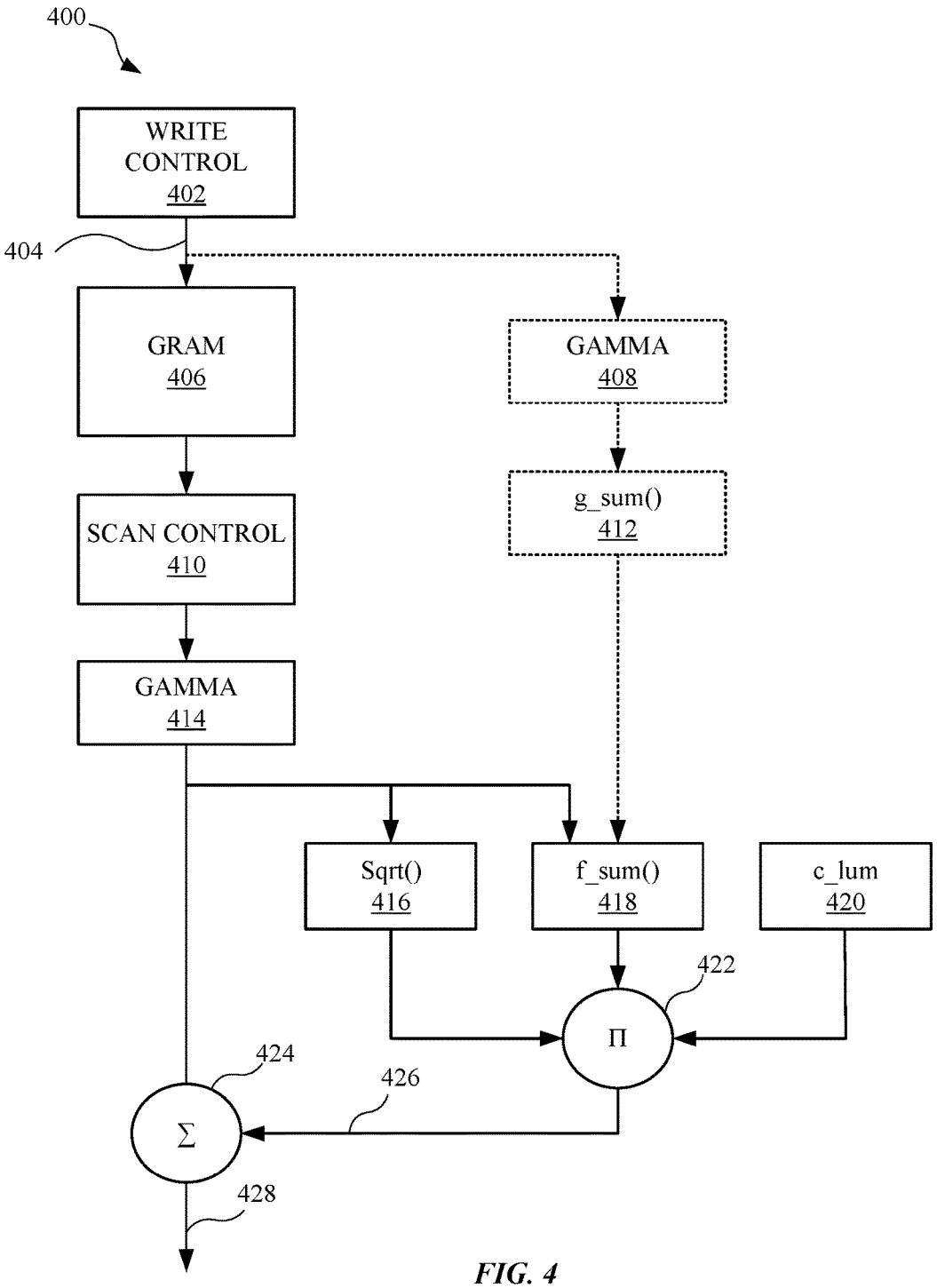
FIG. 4 illustrates a system for using a calibration constant to compensate a signal for an OLED display panel.

FIG. 4 illustrates a system 400 for using a calibration constant to compensate a drive signal for an OLED display panel. The system 400 can be embodied as software within a timing controller (TCON), row driver, column driver, gate driver, or any other suitable device for directly or indirectly controlling an amount of voltage or current that can be provided to a row or column of a display panel. The system 400 includes a write control 402 that can write image data 404 to a graphic random access memory (GRAM) 406. The image data 404 can also be provided to a separate portion of the system 400 responsible for calculating a total amount of current associated with the image data 404. For example, and optionally (as indicated by the dotted lines), the image data 404 can first be received by a gamma module 408 that modifies the image data 404 by converting the image data 404 into serial or linear image data. Next, the serial image data is provided to the g_sum( ) module 412, which calculates a total amount of current associated with the serial image data for all pixels of the display panel. Optionally, and in some embodiments, the total expected voltage drop for one or more rows can be calculated using the total current value ($g_{SUM}(N_{ROWS})$). Thereafter, the total supply voltage drop for one or more supply lines can be calculated by subtracting, from the total current for all display lines (i.e., $g_{SUM}(N_{ROWS})$), a total voltage drop for pixels other than those at the one or more supply lines n.

In FIG. 4, the image data 404 provided to the GRAM 406 can be sent to a scan control module 410 that can then provide the image data to the gamma module 414. However, in some embodiments, each of the gamma modules 408 and 414 are applied to the image data after the luminance correction factor 426 has been applied to the image data. The gamma module 414 can be configured to receive the image data 404 or a portion of the image data and convert the image data into a serial or linear form. The serial image data can thereafter be summed or otherwise combined with a luminance correction value 426 at a summation module 424. The resulting sum can provide image data that is adjusted to correct non-uniform luminance that can occur at a display panel connected to the system 400. The luminance correction value 426 is generated using a sqrt( ) value 416, an f_sum( ) value 418, and a c_lum value 420, as discussed herein. The sqrt( ) value 416 is a square root of a representation of an expected luminance value for one or more pixels that will receive the serial image data, as provided in Equation 9 herein. The f_sum value 418 is an expected voltage drop for one or more pixels, groups of pixels, or rows. This value can be calculated using the serial image data and Equation 8, as discussed herein. For example, during operation, the system 400 can use Equation 8 to calculate an expected voltage drop, the f_sum value 418, based on image data associated with one or more currents for one or more pixels or sub-pixels. Optionally, the f_sum value 418 can be calculated using a total current for all display lines of the display panel from the g_sum( ) module 412 as discussed herein.

The c_lum value 420 of system 400 can be one or more of the calibration constants discussed herein. The c_lum value 420 is multiplied by the resulting f_sum( ) value 418 and the sqrt( ) value 416 at the multiplier module 422. The resulting product from the multiplier module 422 is the luminance correction value 426, which can be added to the serial image data at the summation module 424. As a result, compensated serial image data 428 can be provided to one or more rows, columns, and/or supply lines of a display panel in order to reduce non-uniform luminance of the display panel.

It should be noted that although values for $f_{SUM}(n)$ are discussed herein as being calculated according to a one-dimensional variable such as row, column, and/or pixel, multidimensional variables can be used. For example, when calculating $f_{SUM}(n)$, a matrix value for n can be used in order to calculate $f_{SUM}(n)$ according to a two-dimensional variable. The matrix value for n can correspond to one or more rows, columns, and/or pixels of a display panel. In this way, calculations for representations of voltage drop (i.e., $f_{SUM}(n)$) and/or calculations for representations of total current for a display panel $g_{SUM}(N_{ROWS})$ can be calculated using two-dimensional variables. Furthermore, luminance error can be calculated as a one-dimensional variable or as a two-dimensional variable. For example, luminance error can be a matrix of the same or different values, and the luminance error matrix can be used to compensate one or more signals for one or more columns, rows, sub-pixels, and/or pixels of a display panel.

In some embodiments, a second order correction process is used to compensate a drive signal for an OLED display panel. For example, in order to reduce a linearization error that can occur when compensating a drive signal based on luminance error, a second order correction factor can be combined with the luminance error to reduce voltage drop. The second order correction factor can be calculated by squaring the c_lum value, dividing the squared c_lum value by 2, and thereafter multiplying the resulting value by a square of the f_sum( ) value. The resulting product is the second order correction factor, which can be combined with the serial image data to reduce non-uniform luminance that can occur at an OLED display panel.

Figure 5:
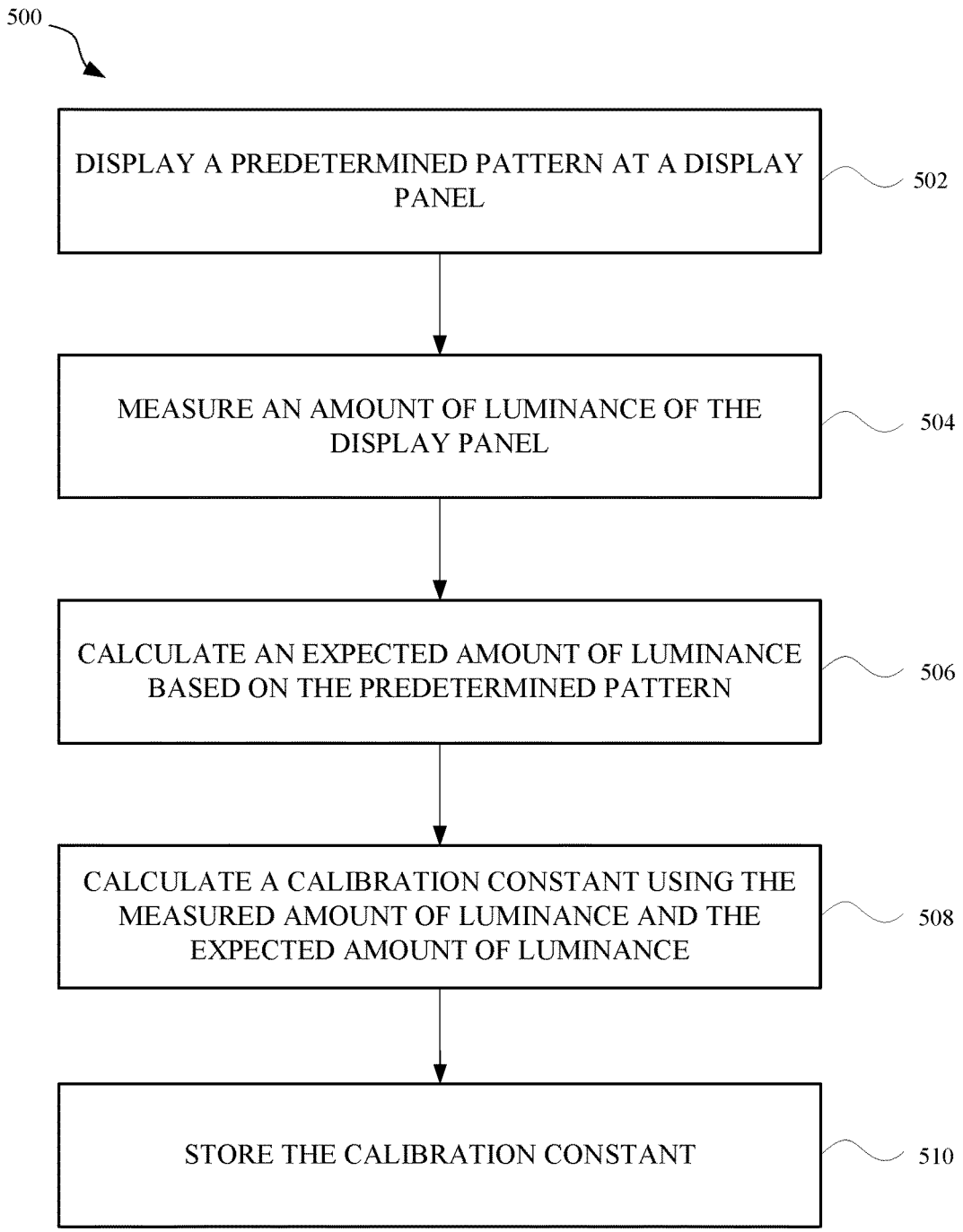
FIG. 5 illustrates a method for calculating one or more calibration constants for a display panel during a calibration of the display panel.

FIG. 5 illustrates a method 500 for calculating one or more calibration constants for a display panel during a calibration of the display panel. The method 500 can be performed by a computing device, a manufacturing device, and/or any suitable device for calibrating a display panel. The method 500 can include a step 502 of displaying a predetermined pattern at a portion of a display panel. The predetermined pattern can be a solid color, a patterned image, a picture of varying luminance, or any other suitable pattern for calibrating a display panel. The method 500 can further include a step 504 of measuring an amount of luminance at the portion of the display panel. The measurement of luminance can be performed by a camera, and the measured amount of luminance can be stored as a value of lumens or any other suitable metric for indicating brightness or intensity of light. The method 500 can further include a step 506 of calculating an expected amount of luminance, or expected change in luminance from a previous iteration of the method 500, based on one or more currents associated with the predetermined pattern. As discussed herein, a predetermined display pattern can be associated with an amount of current that is to be provided to each pixel in a portion of the display panel, and the amount of current can be approximately proportional to an amount of luminance exhibited by the display panel. Therefore, by summing the current used for a particular display pattern and converting the sum to an amount of luminance, the expected amount of luminance or expected change in luminance can be derived. The method 500 can also include a step 508 of calculating a calibration constant for the portion of the display panel using the measured amount of luminance and the expected amount of luminance as discussed herein. Additionally, the method 500 can include a step 510 of storing the calibration constant for the portion of the display panel and, optionally, continuing calibrating the display panel using a different portion of the display panel. The portion of the display panel can refer to a pixel, group of pixels, sub-pixel, a row, a group of rows, a column, and/or a group of columns. Therefore, a calibration constant can be calculated and associated with a pixel, sub-pixel, group of pixels, a row, a group of rows, a column, and/or a group of columns according to method 500 in order to improve luminance uniformity for the entire display panel.

Figure 6:
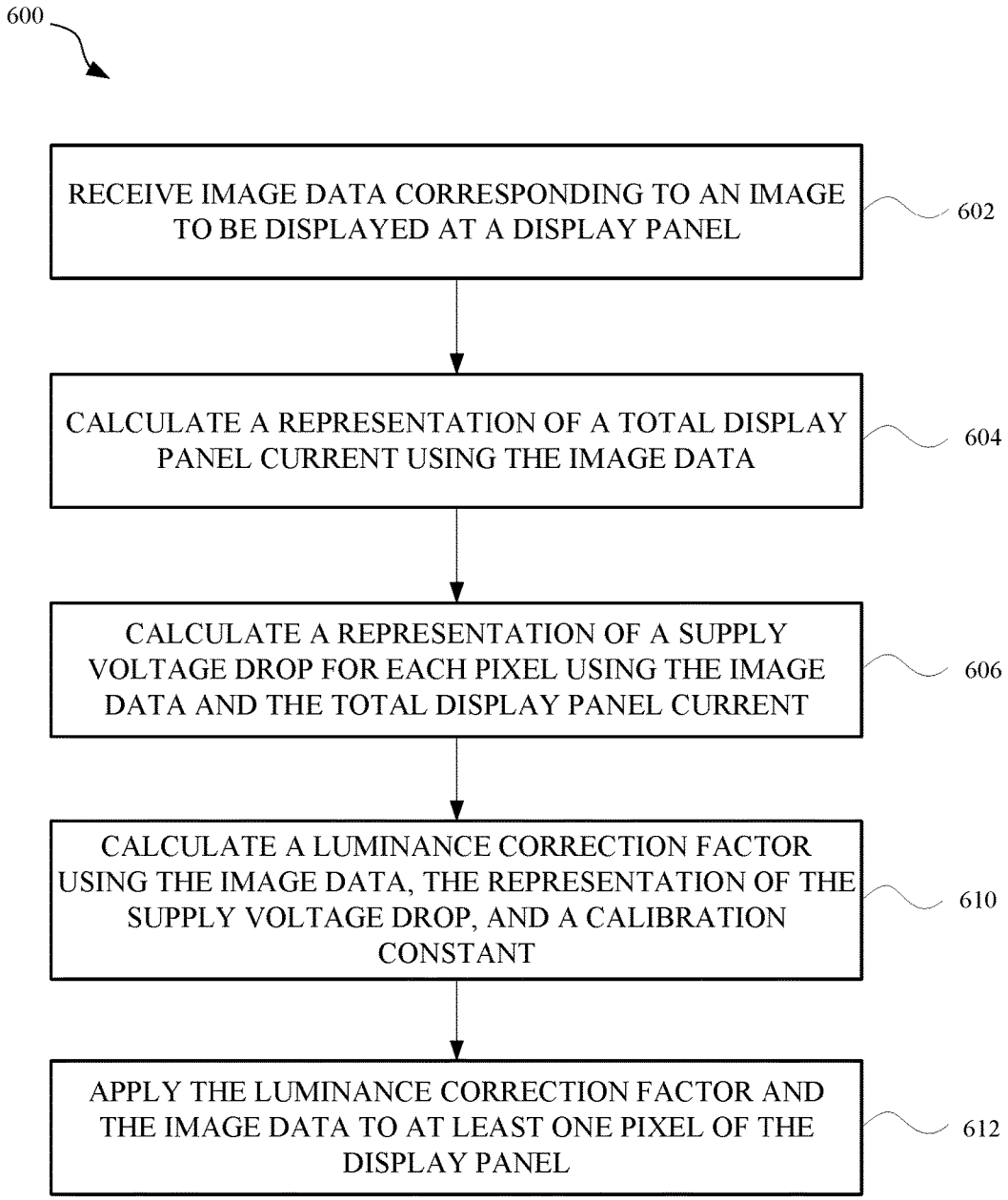
FIG. 6 illustrates a method for calculating a luminance correction factor and compensating a signal to a display panel based on the luminance correction factor in order to mitigate non-uniform luminance at the display panel.

FIG. 6 illustrates a method 600 for calculating a luminance correction value and compensating a signal to a display panel based on the luminance correction value in order to mitigate non-uniform luminance at the display panel. The method 600 can be performed by a processor, a display panel, a display driver, controller, a computing device connected to a display panel, a software module stored by a computing device, or any other suitable device for controlling a display panel. For example, the method 600 can be embodied as software stored by a computing device connected to a display panel. In this way, the software can modify image data before the image data is provided to the display panel in order to reduce non-uniform luminance exhibited by the display panel. However, in some embodiments, the method 600 is embodied as software stored by a display panel in order to modify image data after the image data is received by the display panel in order to reduce non-uniform luminance exhibited by the display panel. The method 600 can include a step 602 of receiving image data corresponding to an image to be displayed at a display panel. However, in some embodiments, the image data received at step 602 corresponds to multiple images that have been and/or are being processed by the display panel. The method 600 can further include a step 604 of calculating a representation of a total display current using the image data. The representation of the total display current can be a current value or any other suitable metric for representing an amount of current. Additionally, the method 600 can include a step 604 of calculating a representation of a supply voltage drop for each pixel using the image data and the representation of the total display panel current. The representation of the supply voltage drop can be a voltage value or any other suitable metric for representing an amount of voltage drop. At step 606, a luminance correction value or luminance error value is calculated using the image data, the representation of the supply voltage drop, and a calibration constant. At step 612, the luminance correction value and the image data are applied to or otherwise provided to at least one pixel of the display panel. In this way, the image data can be modified according to the luminance correction value in order to mitigate any non-uniform luminance experienced by the display panel. As a result, a better user experience is provided while also making a more effective and efficient use of current at the display panel.

Figure 7:
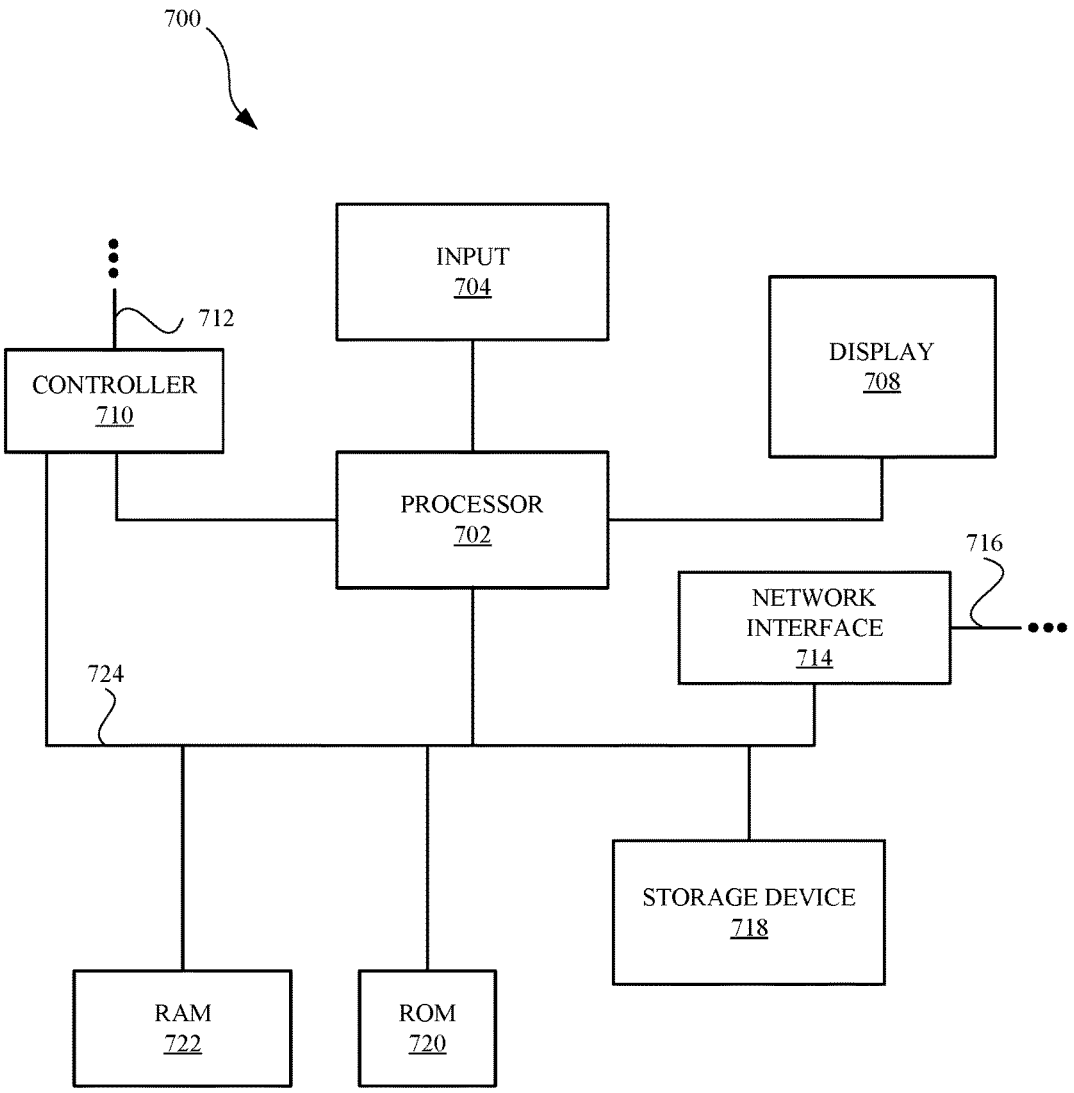
FIG. 7 is a block diagram of a device that can represent the components of a computing device or any other suitable device or component for realizing any of the methods, systems, apparatus, and embodiments discussed herein.

FIG. 7 is a block diagram of a computing device 700 that can represent the components of a computing device 100 or any other suitable device or component for realizing any of the methods, systems, apparatus, and embodiments discussed herein. It will be appreciated that the components, devices or elements illustrated in and described with respect to FIG. 7 may not be mandatory and thus some may be omitted in certain embodiments. The computing device 700 can include a processor 702 that represents a microprocessor, a coprocessor, circuitry and/or a controller for controlling the overall operation of computing device 700. Although illustrated as a single processor, it can be appreciated that the processor 702 can include a plurality of processors. The plurality of processors can be in operative communication with each other and can be collectively configured to perform one or more functionalities of the computing device 700 as described herein. In some embodiments, the processor 702 can be configured to execute instructions that can be stored at the computing device 700 and/or that can be otherwise accessible to the processor 702. As such, whether configured by hardware or by a combination of hardware and software, the processor 702 can be capable of performing operations and actions in accordance with embodiments described herein.

The computing device 700 can also include user input device 704 that allows a user of the computing device 700 to interact with the computing device 700. For example, user input device 704 can take a variety of forms, such as a button, keypad, dial, touch screen, audio input interface, visual/image capture input interface, input in the form of sensor data, etc. Still further, the computing device 700 can include a display 708 (screen display) that can be controlled by processor 702 to display information to a user. Controller 710 can be used to interface with and control different equipment through equipment control bus 712. The computing device 700 can also include a network/bus interface 714 that couples to data link 716. Data link 716 can allow the computing device 700 to couple to a host computer or to accessory devices. The data link 716 can be provided over a wired connection or a wireless connection. In the case of a wireless connection, network/bus interface 714 can include a wireless transceiver.

The computing device 700 can also include a storage device 718, which can have a single disk or a plurality of disks (e.g., hard drives) and a storage management module that manages one or more partitions (also referred to herein as "logical volumes") within the storage device 718. In some embodiments, the storage device 718 can include flash memory, semiconductor (solid state) memory or the like. Still further, the computing device 700 can include Read-Only Memory (ROM) 720 and Random Access Memory (RAM) 722. The ROM 720 can store programs, code, instructions, utilities or processes to be executed in a non-volatile manner. The RAM 722 can provide volatile data storage, and store instructions related to components of the storage management module that are configured to carry out the various techniques described herein. The computing device 700 can further include data bus 724. Data bus 724 can facilitate data and signal transfer between at least processor 702, controller 710, network/bus interface 714, storage device 718, ROM 720, and RAM 722.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable storage medium. The computer readable storage medium can be any data storage device that can store data, which can thereafter be read by a computer system. Examples of the computer readable storage medium include read-only memory, random-access memory, CD-ROMs, HDDs, DVDs, magnetic tape, and optical data storage devices. The computer readable storage medium can also be distributed over network-coupled computer systems so that the computer readable code is stored and executed in a distributed fashion. In some embodiments, the computer readable storage medium can be non-transitory.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A display panel, comprising:

a pixel array comprising a plurality of rows and a plurality of pixels connected to the plurality of rows;

a display driver configured to provide a signal to at least one pixel of the plurality of pixels; and a processor configured to compensate the signal based on:

a luminance error that is calculated by the processor using at least image data corresponding to an image to be displayed by the display panel; and a second order correction that includes a square of an expected voltage drop across one or more rows of the plurality of rows.

2. The display panel of claim 1, further comprising:

a memory configured to store a predetermined calibration constant, wherein the luminance error is further calculated by the processor using at least the predetermined calibration constant.

3. The display panel of claim 2, wherein the luminance error is calculated by the processor using at least image data corresponding to one or more images that were previously displayed by the display panel.

4. The display panel of claim 1, wherein the plurality of pixels include organic light emitting diodes (OLEDS) corresponding to at least three different colors.

5. The display panel of claim 1, wherein the luminance error corresponds to a difference in expected luminance between two different portions of the display panel.

6. The display panel of claim 1, wherein the processor is further configured to convert the image data to serial image data in order to calculate the luminance error.

7. The display panel of claim 1, wherein the second order correction comprises a product of the square of the expected voltage drop and a square of a predetermined calibration constant.

8. A method for reducing non-uniform luminance exhibited by a display panel, the method comprising:

by a processor of the display panel:

determining an expected amount of current for each column of the display panel during execution of the image data;

calculating a luminance error based on (i) a portion of image data to be output by one or more pixels of the display panel and (ii) at least one predetermined calibration constant (iii) the determined expected amount of current;

generating a compensated signal for the one or more pixels of the display panel based on the luminance error; and causing the one or more pixels of a supply line of the display panel to illuminate based on the compensated signal.

9. The method of claim 8, where the luminance error is further based on an expected total current value corresponding to multiple different supply lines of the display panel.

10. The method of claim 8, wherein the luminance error is further based on an expected total current value or voltage value corresponding to multiple different pixels of the display panel.

11. The method of claim 10, further comprising determining the expected total current value by performing a summation over all of the rows of the display panel.

12. The method of claim 8, wherein the at least one predetermined calibration constant is a value that is generated during a calibration of the display panel.

13. The method of claim 8, wherein the at least one predetermined calibration constant is associated with one or more supply lines of the display panel.

14. The method of claim 8, wherein the at least one predetermined calibration constant is associated with one or more pixels, or sub-pixels, of the display panel.

15. The method of claim 8, wherein the image data is serial image data and the method further comprises iteratively calculating the expected amount of current using the serial image data.

16. A display driver, comprising:

a plurality of column outputs configured to provide a signal to a plurality of pixels of a display panel, wherein the signal is compensated by the display driver based on image data received by the display driver; and a memory configured to store at least one calibration constant corresponding to a column or pixel to be charged by the display driver; and a logic unit configured to calculate an amount of compensation to apply to the signal to reduce non-uniform luminance at the display panel, wherein the amount of compensation is based on (i) the at least one calibration constant and (ii) an expected amount of current or voltage to be used to charge different pixels of the display panel according to the image data, wherein the image data is serial image data that is provided to the display driver, and the logic unit is configured to iteratively calculate the expected amount of current using the serial image data, and wherein the expected amount of current is calculated for each column of the display panel during execution of the image data by the display driver.

17. The display driver of claim 16, wherein the at least one calibration constant is generated during manufacturing of the display panel and the display panel is an organic light emitting diode (OLED) display panel.

18. The display driver of claim 16, wherein the amount of compensation is further based on an operating characteristic of the display panel.

19. The display driver of claim 18, wherein the operating characteristic includes temperature or a type of pixel.

20. The display driver of claim 16, wherein the amount of compensation is further based on a root of an expected luminance value for one or more pixels that are to receive the serial image data.

* * * * *